United States Patent [19]

Utsumi et al.

[11] Patent Number: 4,505,500

[45] Date of Patent: Mar. 19, 1985

[54] DOOR LOCK ARRANGEMENT FOR AUTOMOTIVE VEHICLE

[75] Inventors: Shunji Utsumi, Yokosuka; Takayo Chikaraishi, Kawasaki, both of Japan

[73] Assignees: Nissan Motor Company, Limited; Ohi Seisakusho Co., Ltd., both of Japan

[21] Appl. No.: 417,832

[22] Filed: Sep. 14, 1982

[30] Foreign Application Priority Data

Sep. 22, 1981 [JP] Japan ..... 56-149701

[51] Int. Cl.[3] ..... E05C 3/16; E05C 9/16

[52] U.S. Cl. ..... 292/48; 292/DIG. 3; 292/DIG. 26; 292/DIG. 62

[58] Field of Search ..... 292/216, 280, 48, DIG. 25, 292/DIG. 26, DIG. 3, DIG. 23, DIG. 62, 53, 139, 143, 35, 36, 40

[56] References Cited

U.S. PATENT DOCUMENTS

| | | | |
|---|---|---|---|
| 2,911,247 | 11/1959 | Corbin . | |
| 2,926,943 | 3/1960 | Leslie et al. | 292/53 |
| 2,992,032 | 7/1961 | Griswold, Jr. et al. | 292/48 |
| 3,104,902 | 9/1963 | Jaster | 292/36 |
| 3,137,518 | 6/1964 | Dale | 292/36 |
| 3,190,682 | 6/1965 | Fox et al. | 292/216 |
| 3,264,024 | 8/1966 | Di Salvo | 292/48 |
| 3,572,792 | 3/1971 | Foley | 292/216 |
| 3,844,596 | 10/1974 | Torii et al. | 292/280 X |

FOREIGN PATENT DOCUMENTS

| | | |
|---|---|---|
| 1171780 | 1/1961 | Fed. Rep. of Germany . |
| 2048206 | 10/1970 | Fed. Rep. of Germany . |
| 2808152 | 2/1978 | Fed. Rep. of Germany . |
| WO80/01703 | 8/1980 | PCT Int'l Appl. . |
| 370837 | 4/1932 | United Kingdom . |
| 935062 | 8/1963 | United Kingdom . |
| 1229596 | 4/1971 | United Kingdom . |
| 1305840 | 2/1973 | United Kingdom . |

*Primary Examiner*—Gary L. Smith
*Assistant Examiner*—Thomas J. Dubnicka
*Attorney, Agent, or Firm*—Leydig, Voit, Osann, Mayer and Holt, Ltd.

[57] ABSTRACT

A door lock arrangement for a vehicle in which there is no pillar against which the trailing edge of a forwardly hinged door may engage, includes locks provided at the top and bottom corners of the door and a centrally located mechanism for simultaneously operating said locks. This mechanism includes means for producing both of the so called "keyless locking" and "self cancellation" functions.

8 Claims, 9 Drawing Figures

DOOR LOCK ARRANGEMENT FOR AUTOMOTIVE VEHICLE

BACKGROUND OF THE INVENTION

The present invention relates generally to a door lock arrangement for a vehicle door and more specifically to a door lock arrangement for a vehicle having no pillar between adjacent forward and rear doors.

A vehicle having a hinged forward door is inevitably provided with a pillar of some description between it and the adjacent rear door so that the forward door may be provided with a lock having a portion which engages with a member secured to said pillar. However, in the case such a pillar is not available such as in a vehicle wherein a rear sliding door, for example, is adapted to directly engage the trailing rear edge of the front door when both are in the closed position, the normal type of locking arrangement can no longer be used.

SUMMARY OF THE INVENTION

Hence, it is an object of the present invention to provide a door lock arrangement suitable for a door which does not engage a stationary pillar along its rear or trailing edge.

The present invention features an arrangement wherein a unique lock operarting arrangement is provided to operate locks located at the top and bottom of the door adjacent the trailing edge thereof so as to provide a four point support arrangement including the two hinges provided at the forward edge of the door.

More specifically the invention takes the form of an apparatus for operating door locks of a vehicle, comprising an upper door lock mounted in an upper portion of a door to be engageable with an upper striker which is secured to an upper portion of a body of the vehicle, a lower door lock mounted in a lower portion of the vehicle body to be engageable with a lower striker which is secured to a lower portion of the vehicle body and a central operation assembly located in said door, said central operation assembly being operatively connected with the upper and lower door locks and operatively connected with an inside handle and an outside handle such that manipulating one of the inside handle and the outside handle in an unlatching direction releases the upper door lock and the lower door lock, said central operation assembly being further operatively connected with a key operable lock cylinder and a locking knob such that operating one of the lock cylinder and the knob in a locking direction cancels the operative connection between the inside and outside handles and the upper and lower door locks.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
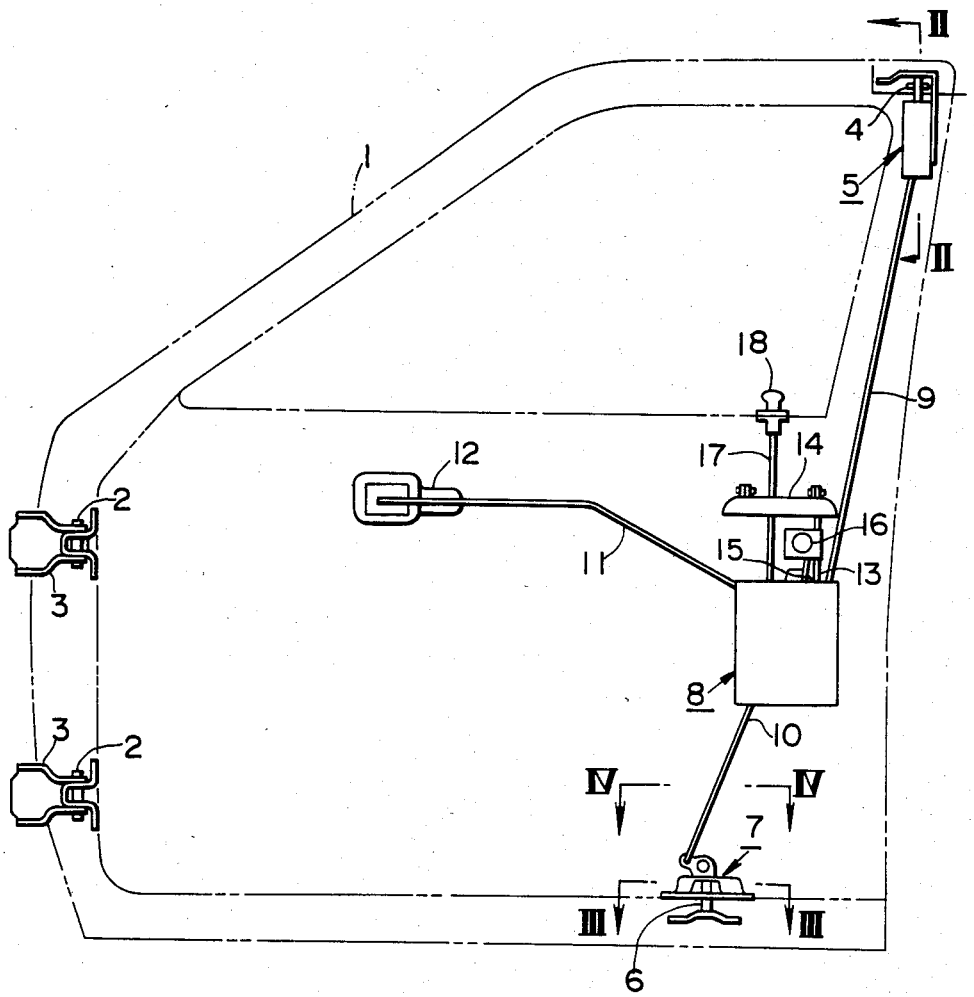
FIG. 1 is a side elevation of a door incorporating a door lock operating arrangement according to the present invention.

Referring to FIG. 1, a first embodiment of the present invention is shown in which a front door 1 of a vehicle is pivotally mounted to the body of the vehicle by upper and lower hinges 3, each of which has a pivot shaft 2.

An upper door lock 5 is disposed in the upper rear corner of the door 1 so as to be engageable with an upper striker 4 rigidly mounted on the roof of the vehicle. Disposed in a lower portion of the door 1 adjacent to the rear corner thereof is a lower door lock 7. The latter is engageable with a lower striker 6, rigidly mounted on the floor or chassis of the vehicle.

The door 1 is further provided with a central lock operating assembly 8. This assembly is operatively connected with the upper door lock 5 via a rod 9 and with the lower door lock 7 via a rod 10.

An interior door handle 12 is located in a suitable location on the inner surface of the door 1, while an outside door handle 14 is suitably positioned on the exterior thereof. The assembly 8 is interconnected with the inside handle 12 by means of a rod 11 and with the outside handle 14 by means of a rod 13. When either one of the inside handle 12 or the outside handle 14 is manipulated to open the door 1, the operation assembly 8 releases the upper door lock 5 and lower door lock 7 simultaneously from the upper striker 4 and lower striker 6, respectively.

A key operable lock cylinder 16 is located in a suitable position within the door 1, while a locking/unlocking knob 18 is adapted to protrude from a location at the base of the door window. The operating assembly 8 is operatively connected with the lock cylinder 16 by means of a rod 15 and with the knob 18 via a rod 17. When the lock cylinder 16 or the knob 18 is operated to lock the door 1, the operative connection between the inside handle 12 and outside handle 14 and the upper door lock 5 and lower door lock 7 is cancelled.

Figure 2:
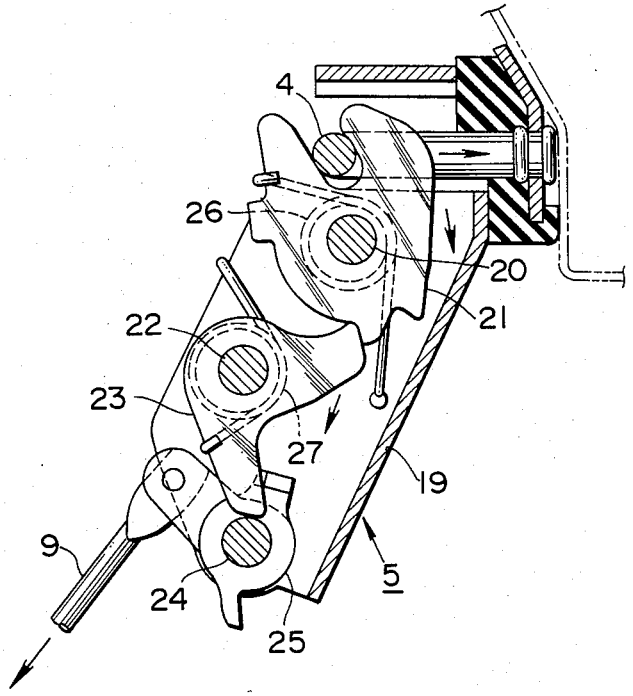
FIG. 2 is a sectional elevation taken along section lines II—II of FIG. 1 of a lock mechanism which may be utilized at the upper rear corner of the door.

As shown in FIG. 2, the upper door lock 5 includes a base plate 19 having a generally U-shaped configuration as seen in plan, which is rigidly mounted on the door 1. A latch member 21 is pivotally mounted on the base plate 19 by means of a pin 20 so as to engage the outboard end of the upper striker 4, which is secured to the vehicle body and which is generally U-shaped as seen in plan. A pawl member 23 is pivotally mounted on the base plate 19 by means of a pin 22. This member functions to prevent the latch member 21 from being rotated after the latter has engaged with the upper striker 4 upon the door being closed. A lever 25 is pivotable about a pin 24 mounted on the base plate 19. The upper end of the rod 9 is anchored to the lever 25 such that, when the rod 9 is drawn downwardly the lever 25 causes the pawl member 23 to undergo clockwise rotation (as seen in FIG. 2), thus releasing the pawl member 23 from the latch member 21.

The upper door lock 5, is arranged such that, when the door 1 is closed, the rod 9 does not follow the movement of the latch member 21 and remains stationary. The latch member 21 is constantly biased clockwise by a helical spring 26 as seen in FIG. 2, while the pawl member 23 is constantly biased counterclockwise by a helical spring 27.

Figure 3:
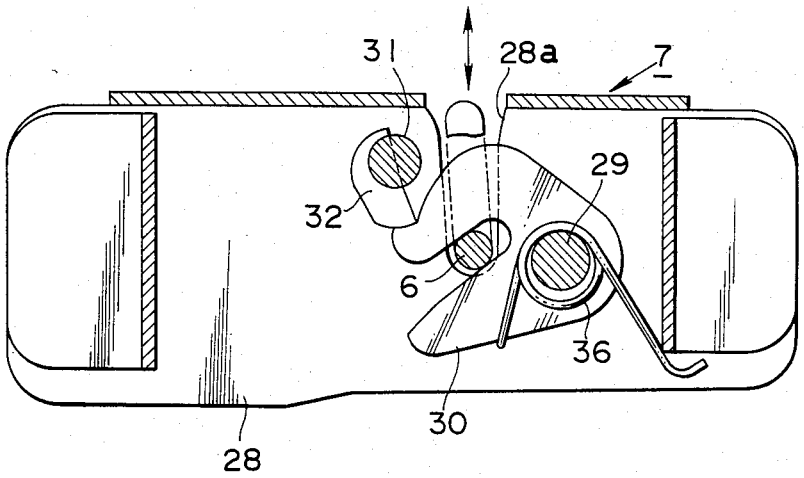
FIG. 3 is a view taken along section lines III—III of FIG. 1 of a lock mechanism which may be provided at the lower rear corner of the door.
Figure 4:
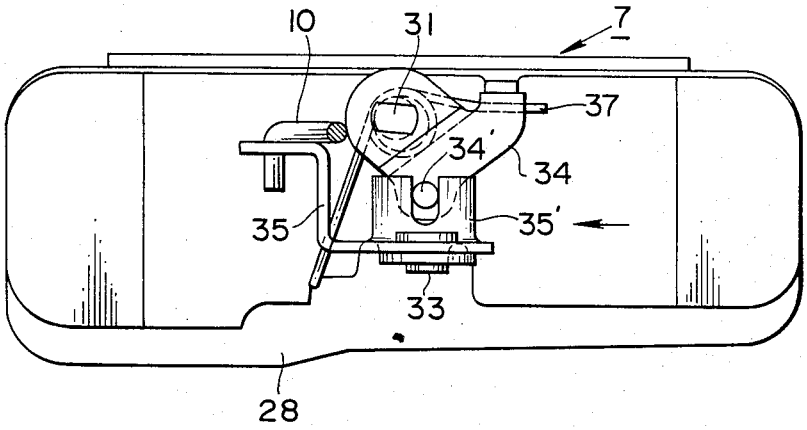
FIG. 4 is a view of the arrangement shown in FIG. 3 but taken along section line IV—IV of FIG. 1.

Referring now to FIGS. 3 and 4, the lower door lock 7 has a box-shaped base 28 which is rigidly mounted on the door 1. The base 28 is formed with an opening **28*a* through which the lower striker 6, having a generally U-shaped front elevation, can enter. A latch member 30 is pivotally mounted on the base 28 by a vertically extending pin 29 to be engageable with an outboard stem portion of the lower striker 6. A pawl member 32 is pivotally mounted on the base 28 by means of a pin 31 so as to prevent the rotation of the latch member 30 once the latter has engaged with the lower striker 6. A lever 35 is rotatably mounted on the base 28 by a pin 33 which extends transversely with respect to the door 1. The lever 35 is operatively connected with the pin 31 on which the pawl member 32 is mounted, by way of a lever 34. The lever 34, as shown, has a pin 34' slidably received in a slot (no numeral) formed in a flange-like extension 35' of the lever 35**.

The lower end of the rod 10 is anchored to one end of the lever 35 so that when drawn upwardly, it will cause the pin 31 and the pawl 32, which is integral with the pin 31, to rotate clockwise (as seen in FIG. 3) via the lever 34. This disengages the latch 30 from the lower striker 6 to permit the door 1 to open.

When the door 1 is closed, the lower striker 6 engages the latch 30. Upon counterclockwise movement of the latch 30 as seen in FIG. 3, the pawl 32 is moved clockwise so that the rod 10 is caused to move up and then down.

The latch 30 is biased clockwise (as seen in FIG. 3) by a helical spring 36, while the pawl 32 and the pin 31, are biased counterclockwise by a helical spring 37.

Turning now to FIGS. 5–9, the construction of the assembly 8 which forms a vital part of the present invention will be discussed in detail.

The lock operating assembly 8 includes a base plate 38 rigidly secured to the door 1. At the upper portion of the base plate 38, a release lever 40 is pivotally mounted on a pin 39 which is perpendicular to the general plane of the base plate 38. It should be noted at this time, that all the pins referred to hereinafter are also perpendicular to the general plane of the base plate 38.

A helical spring 41 is wound round the pin 39 and one end **41*a* thereof anchored to the pin 39. The other end 41*b* of this spring is anchored to a lug 42 which extends forwardly from the left edge of the release lever 40 at a location below the pin 39 and at an angle relative to same. The spring 41 thus yieldably urges the release lever 40 counterclockwise to its inoperative position shown in FIG. 5, in which a lug 43 extending rearwardly from the lower end of the release lever 40 abuts against a first stop 44*a*. This stop 44*a* delimits the right end of an arcuate notch 44 and is formed on an intermediate portion of the base plate 38**.

The release lever 40 is formed with an arcuate slot 45 whose center of curvature coincides with the axis of the pin 39. A pin 46 slidable in and along the arcuate slot 45 is fixed to one end of the rod 11, the other end of which as previously described is operatively connected with the interior door handle 12. Pulling the rod 11 to the left as seen in the drawings will move the release lever 40 to its operative position shown in FIG. 6, in which the lug 43 abuts against a second stop **44*b*. This second stop delimits the left end of the notch 44**.

Figure 5:
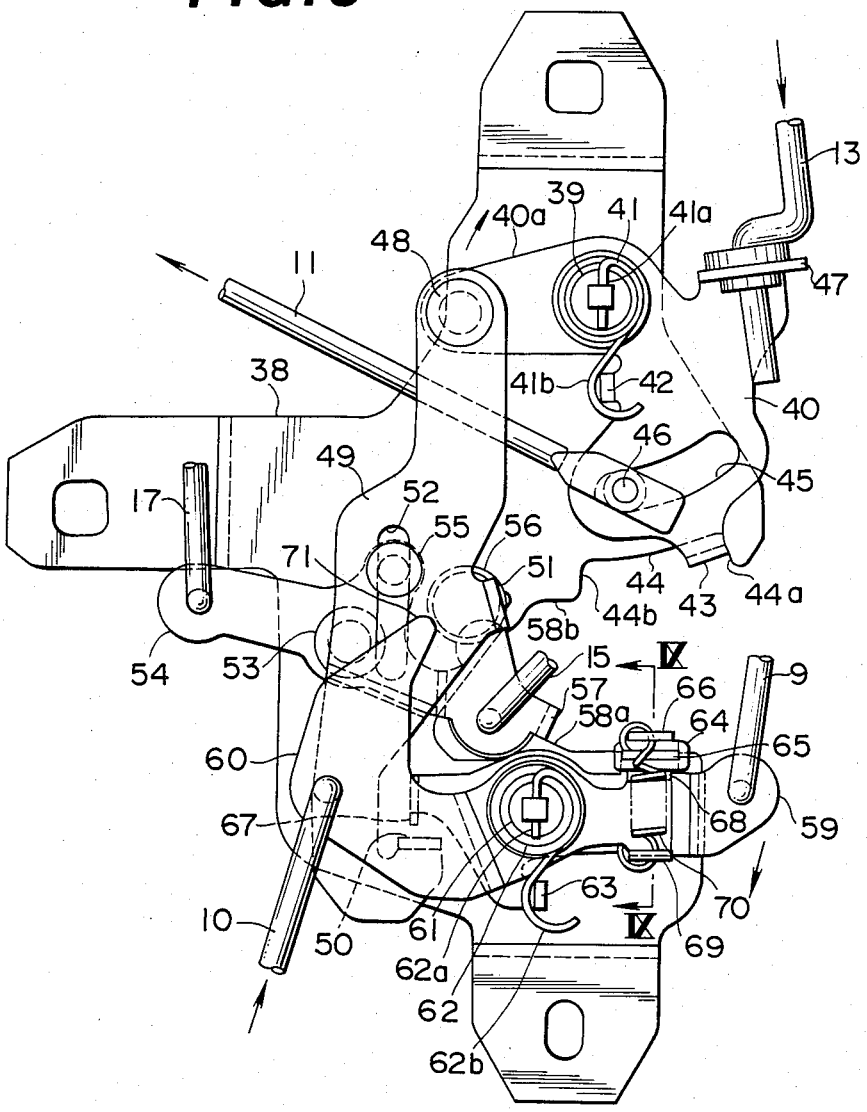
FIG. 5 is a front elevation of a central operation assembly of the present invention, showing a locking lever in an unlocked position and a release lever in an inoperative position.

The rod 13 which is operatively connected with the exterior door handle 14 is formed with a stepped portion which, as shown in FIG. 5 is disposed through an aperture in which an elastomeric grommet (no numeral) is disposed and which is formed in a lug 47 formed on the release lever 40. With this arrangement urging the rod 13 downwardly will also move the release lever 40 to the operative position illustrated in FIG. 6.

An arm **40*a* extends to the left from an upper portion of the release lever 40 and has a sublever 49 rotatably mounted on the free end thereof by means of a pin 48**.

The lower end of the sublever 49 is formed so as to have a generally "J" shape which terminates at an engaging section 50. This engaging section 50 is formed by bending the end of the sublever 49 to the rear (as seen in the drawings).

An abutment 51 extends forwardly from the right edge of an intermediate portion of the sublever 49. This abutment is located such that when the release lever 40 is in the inoperative position thereof the abutment protrudes into a path of rotation of a hook-shaped end or engaging section 71 of a second connecting lever 60, which will be described in detail later, while in the operative position of the release lever 40, it is raised upwardly out of the path of rotation mentioned above.

The sublever 49 is formed with a slot 52 in the intermediate portion thereof. A locking lever 54 is rotatably mounted on an intermediate part of the base plate 38 by means of a pin 53. A pin 55 is studded on the lever 54 above the pin 53 and slidably engaged in the slot 52.

The locking lever 54 is operatively connected to an overcenter or two position snap action spring 56 so as to be biased toward either one of two positions. This spring is retained at one end by the base plate 38 and at the other end by the lever 54. In the unlocked position of the locking lever 54 (shown in FIG. 5) a rearwardly oriented lug 57 formed at the right end of the lever 54 abuts against a first stop **58*a* formed in a curved edge of an intermediate portion of the base plate 38, whereas in the locked position (shown in FIG. 7) the lug 57 abuts against a second stop 58*b* formed in a curved edge of the base plate 38** which faces the above-mentioned edge from above.

The lever 54 is connected at the left end thereof to the lower end of the rod 17 which, as previously described, is connected to the lock button or knob 18, and at a position adjacent to the right end thereof with the rod 15 which in turn is connected to the lock cylinder 16. The lever 54 is thus movable to the locked or unlocked position when either one of the knob 18 or the lock cylinder 16 is operated and maintained in the selected position under the influence of the spring 56.

With the above arrangement, when the lever 54 assumes the unlocked position thereof, the sublever 49 also assumes an engaged position as shown in FIG. 5. With levers 54, 49 in these positions the engaging section 50 is engageable with an abutment 67 of a first connecting lever 59 which will be described hereinlater.

However, upon the lever 54 assuming its locked position (see FIG. 7) the sublever 49 assumes a position in which the engaging section 50 is no longer engageable with the abutment 67.

Thus, when the sublever 49 is in the engaged position thereof it can be raised by moving the release lever 40 to the operative position so that the abutment 67 is engaged by and moved upward by the engaging section 50 thus rotating the first connecting lever 59. However, in the released position of the sublever 49, the engaging section 50 misses the first connecting lever 59 despite the movement of the release lever 40 into the operative position.

The first and second connecting levers 59 and 60 are pivotally mounted on a lower part of the base plate 38 by means of a common pin 61. A helical spring 62 is wound round the pin 61 and anchored at one end **62*a* to same. The other end 62*b* of the spring 62 is anchored to a forwardly directed lug 63 formed on the lower edge of the first connecting lever 59. Under the bias of the spring 62, the first connecting lever 59 normally remains in an inoperative position (shown in FIG. 5), in which a lug 65 formed on the right upper edge of the lever 59 and about which an elastomeric cushioning member 64 is disposed, abuts against a forwardly directed stop 66 formed on the base plate 38**.

The first connecting lever 59 is formed with the previously mentioned abutment 67 at its leftmost end while retaining the lower end of the rod 9 at its rightmost end, the latter mentioned rod 9 providing an operative connection with the upper door lock 5 as previously described.

Thus, when the locking lever 54 is in the unlocked position thereof and the sub lever 49 is raised, the engaging section 50 contacts the first connecting lever 59 rotating same clockwise thus pulling rod 9 downwards to release the upper door lock 5.

A pair of lugs 68 and 69 extend forwardly from the right upper end and right lower end of the second connecting lever 60, respectively. A coil tension spring 70 is retained at its one end by a lower lug 69 of the lever 60 and at the other by stop 66 of the base plate 38. The lever 60 is biased counterclockwise by the spring 70 to normally assume an inoperative position shown in FIG. 5, in which the upper lug 68 remains in contact with the cushioning member 64 on the lug 65 of the first connecting lever 59.

The second connecting lever 60 is connected to the rod 10 (operatively connected to the lower door lock 7) at its left end and formed at the upper extension thereof with the hook-shaped end 71 previously mentioned.

Figure 6:
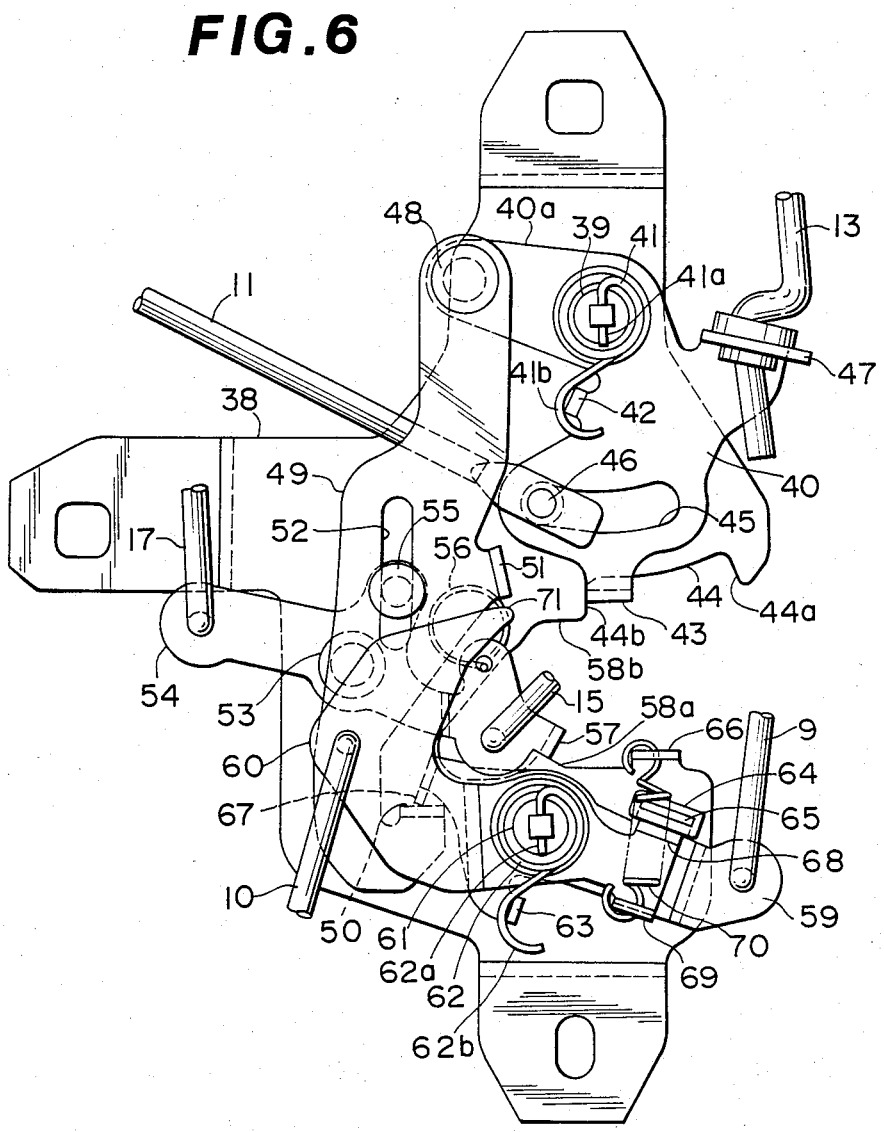
FIG. 6 is a front elevation of the central operation assembly showing the locking lever in the unlocked position and the release lever in an operative position.
Figure 7:
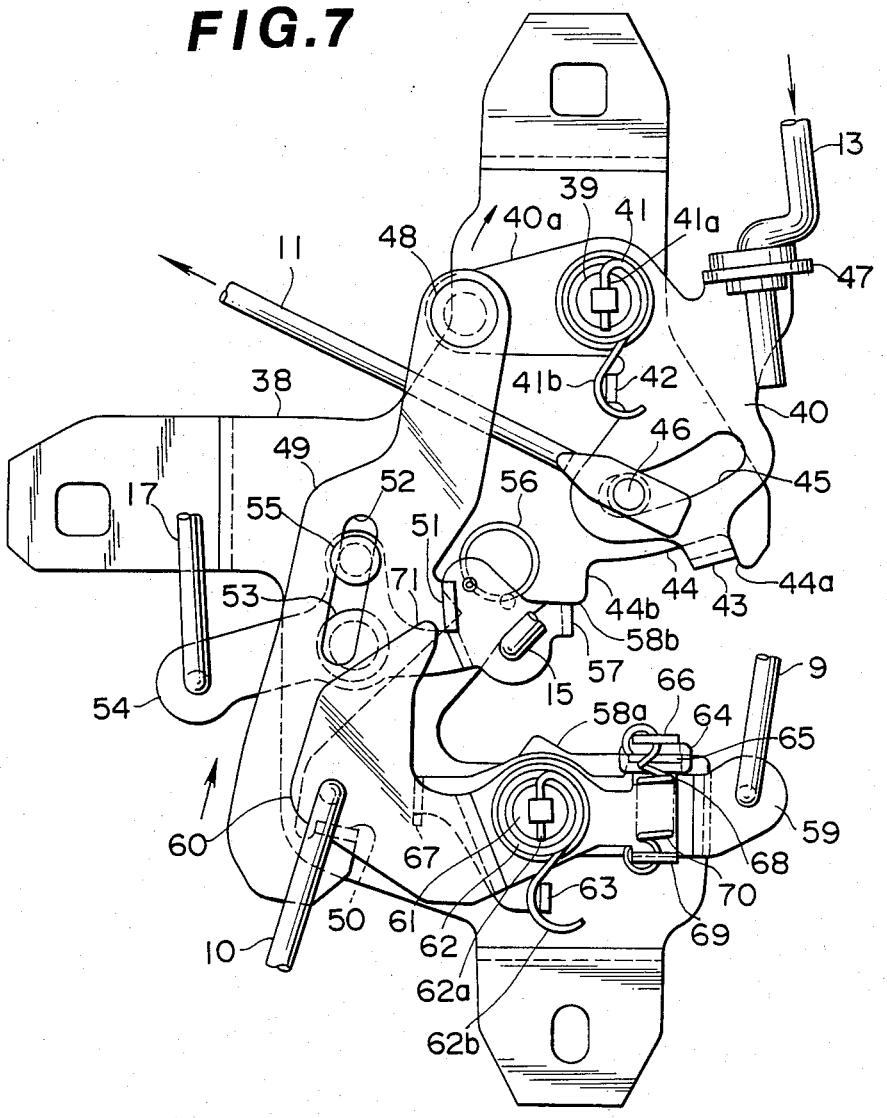
FIG. 7 is a front elevation of the central operation assembly showing the locking lever in a locked position and a release lever in the inoperative position thereof.

Due to the engagement of the lug 68 with the lever 59, the lever 60 is rotated to the operative position shown in FIG. 6 in synchronism with the lever 59 from its inoperative position to the its operative position thus pulling the rod 10 upwardly to release the lower door lock 7.

Figure 8:
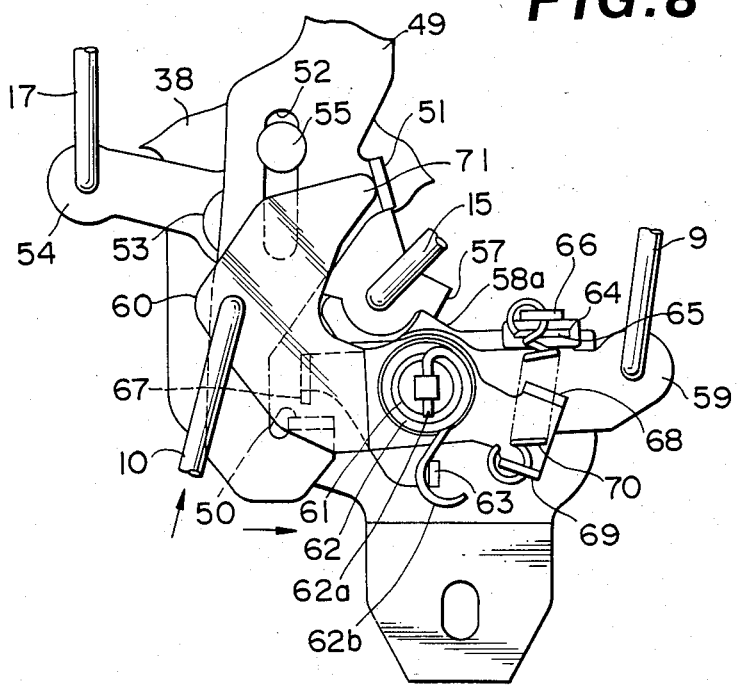
FIG. 8 is a fragmentary front view elevation of the central operation assembly under "self-cancellation"
Figure 9:
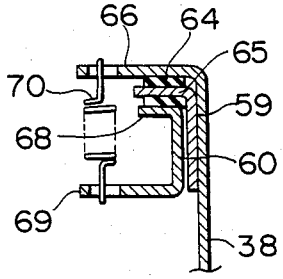
FIG. 9 is a vertical section taken along line IX—IX of FIG. 5.

However, the second connecting lever 60 is movable to its operative position independently of the first connecting lever 59 as already discussed and as shown in FIG. 8, when the rod 10 is raised temporarily via the interconnection with the latch 30 in the lower door lock 7 during the closing of the door 1. Thus, assuming that the sublever 49 is in the released positiion and the release lever 40 is in the inoperative position, the hook-shaped end 71 of the lever 60 will engage with the abutment 51 to cause the sublever 49 to return to its engaged position. This induces a simultaneous movement of the locking lever 54 from the locked position to the unlocked position thereof.

This endows the so-called "self-cancellation" function on the arrangement which unlocks the door 1 even though the door may be closed with the lock cylinder 16 or the knob 18 actuated to the locked position, at the instant the door 1 is closed.

However, if the outside handle 14 is manually held to keep the release lever 40 in its operative position while the door 1 is closed, both the lever 54 and sublever 49 are maintained in their locked and released positions respectively and the rod 10 rises and moves the second connecting lever 60 to its operative position. Thus, because the abutment 51 has then been raised by the release lever 40 out of the path of the engaging section 71, and the sublever 49 maintains its released position.

This endows the so-called "keyless locking" function on the arrangement which permits the door 1 to be locked without the use of a key.

The operation of the above construction is as follows.

While the locking lever 54 is held in the unlocked position through the lock cylinder 16 or the knob 18, the sublever 49 is also maintained in its engaged position. Under these conditions, the door 1 can be opened by manipulating the inside handle 12 or the outside handle 14 to move the release lever 40 to the operative position, so that the sublever 49 is raised to move the first connecting lever 59 and second connecting lever 60 clockwise at the same time and, thereby, release the upper door lock 5 and lower door lock 7 simultaneously.

When either of the lock cylinder 16 or the knob 18 has been operated for locking the door 1, the locking lever 54 and the sublever 49 are caused to assume their locked and released positions respectively. In this situation, operating the inside handle 12 or the outside handle 14 will simply cause the sublever 49 to swing without making any lock releasing contact, whereby neither the first connecting lever 59 nor the second connecting lever 60 is moved whereby the door 1 is maintained locked.

In such a case, moving the lock cylinder 16 or the knob 18 to its unlocked position will move the lever 54 into its unlocked position so that the door 1 can be opened by the manipulation and mechanical actions described above.

When the door 1 is closed with the lever 54 in its locked position, the latch 30 in the lower door lock 7 is rotated producing an upward movement of the rod 10. Thus, the second connecting lever 60 is moved to its operative position so that the abutment 51 is urged by the engaging section 71 to establish the "self-cancellation" condition and allows the lever 54 to automatically return to its unlocked position. It will be seen such a procedure assists in preventing one from inadvertently locking the door 1 leaving a key inside the passenger compartment.

Conversely, the "keyless locking" can be performed by maintaining the lever 54 in the locked position and then closing the door 1 while pulling manually manipulating the outside handle 14. Such an intentional operation tends to preclude the fear of inadvertent "keyless locking" operation and is rather desirable in permitting the door to be locked without a key.

In summary, it will be seen that the present invention provides an arrangement suited for use with a door lock device of the type having a pair of door locks arranged vertically one above the other. It will also be seen that the operation apparatus is furnished with all the functions required for conventional door locks such as "self-cancellation" and "keyless locking" and, furthermore, permits simultaneous release of both of the upper and lower locks.

It will be noted that the first and second connecting levers may be formed integrally with each other though shown and described as separate members.

It will be also noted that the internal structure of each of the upper and lower door locks 5 and 7 may be replaced by any desired other type if deemed meritorious.

What is claimed is:

1. An apparatus for operating door locks of a vehicle, comprising:

an upper door lock mounted in an upper portion of a door and adapted to be engageable with an upper striker which is secured to an upper portion of a body of the vehicle;

a lower door lock mounted in a lower portion of the door and adapted to be engageable with a lower striker which is secured to a lower portion of the vehicle body;

an inside door handle, an outside door handle, a key operable lock cylinder and a locking knob, mounted on said door;

a central operation assembly located in said door, said central operation assembly including a base plate, first and second connecting levers pivotably mounted for rotational movement in synchronism in the same direction about an axis on said base plate and connected, respectively, with one of the upper and lower door locks, a release lever and a sublever on said base plate providing with said connecting levers an operative connection between said inside door handle and said outside door handle and said door locks, such that manipulating one of said inside door handle and said outside door handle in an unlatching direction rotates said connecting levers in synchronism and releases the upper door lock and the lower door lock, a locking lever mounted on said base plate and operatively connected with said sublever and said key operable lock cylinder and said locking knob such that operating one of the lock cylinder and the knob in a locking direction establishes a locked position of said locking lever and cancels the operative connection provided by said release lever and sublever and connecting levers between the inside and outside handles and the upper and lower door locks.

2. An apparatus according to claim 1 having a self cancellation function which unlocks the door, including a mounting for said second connecting lever allowing rotational movement thereof independently of said first connecting lever, a connection between said second connecting lever and one of the door locks producing independent rotational movement of said second connecting lever in response to engagement of said one of the door locks by the corresponding striker when the door is closed with one of the lock cylinder and the locking knob in the locked position, and an operative connection producing movement of the locking lever to an unlocked position from a locked position established by one of the lock cylinder and the knob.

3. An apparatus for operating door locks of a vehicle, comprising:

an upper door lock mounted in an upper portion of a door and adapted to be engageable with an upper striker which is secured to an upper portion of a body of the vehicle;

a lower door lock mounted in a lower portion of the door and adapted to be engageable with a lower striker which is secured to a lower portion of the vehicle body;

a lock cylinder and a locking knob on the door, inside and outside handles on the door manipulable in unlatching and latching directions;

a central operation assembly locked in said door, said assembly including:

a base plate rigidly mounted on the door;

a release lever pivotally connected to the base plate and operatively connected with the inside and outside handles, said release lever being normally held in an inoperative position and movable from the inoperative position to an operative position when the inside or outside handle is manipulated in the unlatching direction, a locking lever pivotally mounted on the base plate and operatively connected with the lock cylinder and the knob, said locking lever being movable to a locked position or an unlocked position when one of said lock cylinder and the knob is manipulated, a first connecting lever pivotably mounted on the base plate and operatively connected with one of the upper and lower door locks, said first connecting lever normally assuming an inoperative position when the door lock is held in engagement with the corresponding striker and being movable from the inoperative position to an operative position to disengage the door lock from the corresponding striker, said first connecting lever being provided with an abutment at one end thereof, a second connecting lever pivotably mounted on the base plate and operatively connected with the other of the upper and lower door locks, said second connecting lever normally assuming an inoperative position when a latch of said other door lock is to be maintained in engagement with the corresponding striker, while being movable to an operative position where said latch is disengageable with the corresponding striker, said second connecting lever being connected with the first connecting lever such that it moves to the operative position in synchronism with the first connecting lever only when said first connecting lever moves to the operative position, the second connecting lever being provided with an engaging section at one end thereof, and a sublever pivotably connected at one end thereof to said release lever and operatively connected at an intermediate portion thereof to said locking lever, said sublever being provided at the other end thereof with an engaging section engageable with the abutment of the first connecting lever, and further provided at one side edge thereof with an abutment engageable with the engaging section of the second connecting lever, the sublever being movable between a released position where the engaging section of said sublever is not engaged with the abutment of said first connecting lever and an engaged position where the engaging section of said sublever is engaged with the abutment of said first connecting lever, so that when said sublever assumes said engaged position and said release lever is rotated to its release position, said engaging section of said sublever engages said abutment of said first connecting lever inducing said first and second connecting levers to pivot toward their respective operative positions, and when said sublever assumes said released position and said release lever is rotated to its operative position, said engaging section does not engage with said abutment and said first and second connecting levers are not induced to move, said inside and outside door handles being operatively connected by said release lever, sublever and said connecting levers with said door locks such that manipulating one of said inside door handle and said outside door handle in an unlatching direction releases said door locks, and operating one of the lock cylinder and the knob in a locking direction cancels the operative connection provided by said release lever, sublever and said connecting levers between the inside and outside handles and said door locks.

4. An apparatus as claimed in claim 3, in which the first and second connecting levers are formed integrally with each other.

5. An apparatus as claimed in claim 3 further comprising an overcenter spring operatively connected with said locking lever for biasing same toward a selected one of said locked and unlocked positions.

6. An apparatus as claimed in claim 3, further comprising an elastomeric member attached to said first connecting lever and adapted to abut a portion of said base plate upon said first connecting lever assuming said operative position.

7. An apparatus as claimed in claim 3, wherein said locking lever is operatively connected to said locking knob and wherein said release lever is operatively connected to said inside door handle and said outside door handle, said inside door handle being connected to said release lever through a lost motion linkage which allows for the release lever to be rotated under the influence of said outside door handle without influencing said inside door handle, said outside door handle being connected to said release lever through a lost motion linkage which allows for the release lever to be rotated under the influence of said inside door handle without influencing said outside door handle.

8. An apparatus as claimed in claim 3 further comprising keyless locking means for allowing the door to be locked from the exterior of the vehicle without operating said key operable lock cylinder, said means comprising:

said locking lever;

said release lever; and said sublever;

said locking lever, said release lever and said sublever cooperating so that when said lock lever is moved to said locked position via manual operation of said locking knob and said sublever is moved to said released position via said release lever being rotated to said operative position under the influence of said outside door handle being manually moved to and maintained in an unlocking position thereof, said lock lever remains in said locked position irrespective of the door being closed and said second connecting lever being moved, due to its operative connection with said other door lock, to a position which would normally cause said engaging section to engage said abutment of said sublever and cause said lock lever to move from said locked position to said unlocked position.

* * * * *